US007214081B1

(12) United States Patent
Ju

(10) Patent No.: US 7,214,081 B1
(45) Date of Patent: May 8, 2007

(54) SOCKET FOR RESILIENT ELECTRICAL CIRCUIT BOARD

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/387,799

(22) Filed: Mar. 24, 2006

(51) Int. Cl.
*H01R 13/15* (2006.01)

(52) U.S. Cl. ..... 439/260; 439/495

(58) Field of Classification Search ..... 439/260, 439/495, 352
See application file for complete search history.

(56) References Cited

U.S. PATENT DOCUMENTS

| | | | | |
|---|---|---|---|---|
| 6,524,124 | B2 * | 2/2003 | Yamane | 439/260 |
| 6,679,713 | B2 * | 1/2004 | Miura | 439/260 |
| 6,790,074 | B1 * | 9/2004 | Chiu | 439/495 |
| 6,971,908 | B2 * | 12/2005 | Shiu et al. | 439/495 |
| 2002/0045374 | A1 * | 4/2002 | Kunishi et al. | 439/260 |
| 2002/0106924 | A1 * | 8/2002 | Uehara | 439/260 |
| 2005/0118849 | A1 * | 6/2005 | Okita et al. | 439/260 |

FOREIGN PATENT DOCUMENTS

| | | |
|---|---|---|
| CN | 00216858.8 | 1/2001 |

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

A socket includes an insulating housing, a set of first contacts, a set of second contacts, and a movable cover; wherein the insulating housing has a set of first receiving slots and a set of second receiving slots formed in an alternate manner so the first and second contacts are arranged in the first and second receiving slots respectively. Each of the first contacts has an upper arm to abut against the movable cover and to prevent the movable cover lifting therefrom. Each of the second contacts has a conjunction portion and a resilient arm extending from a lateral side of the conjunction portion. The resilient arm has a projection portion protruding downwardly. The projection portion is forced to abut against a resilient electrical circuit board while the movable cover is pressed on the resilient arm of the respective second contact downwards.

6 Claims, 8 Drawing Sheets

SOCKET FOR RESILIENT ELECTRICAL CIRCUIT BOARD

BACKGROUND OF THE INVENTION

1. Field of the Invention

The present invention relates to a socket, and especially to a socket electrically connected an electrical circuit board to a resilient one.

2. Description of the Related Art

A socket electrically connected an electrical circuit board to a resilient one is usually assembled to the electrical circuit board via an insulating housing thereof and has a plurality of contacts arranged in the receiving slots thereof respectively. The insulating housing includes a plurality of openings communicating with the respective receiving slots for accommodating with an end part of the resilient electrical circuit board. Therefore, the contacts of the electrical circuit board electrically connect to the resilient electrical circuit board. In addition, the insulating housing further is equipped with a movable cover in order to conclude the resilient electrical circuit board to be received into the socket.

China Patent No. 00216858.8 discloses a socket having a base, a cover and a plurality of contacts. The base has body, a lateral sidewall and a top wall. The cover is arranged on the body of the base. After a resilient electrical circuit board inserts into the socket, the cover can be further forced to rotate. Thus, the resilient electrical circuit board is pressed to abut against the contacts for electrical connection.

However, the disadvantage of the socket mentioned above is: the bad contact between the electrical circuit board and the resilient one due to the inaccuracy existed in the assembly process, because the connection between them is via the cover abutting against the resilient electrical circuit board. Any unbalance or insufficient force between the electrical circuit board and the resilient one causes the bad contact between them.

Therefore, a newly socket to overcome the disadvantage of the conventional one mentioned above should be provided.

SUMMARY OF THE INVENTION

A socket according to the present invention is provided to guarantee the excellent electrical connection between an electrical circuit board and a resilient one.

A socket according to the present invention includes an insulating housing, a set of first contacts, a set of second contacts, and a movable cover; wherein the insulating housing has a set of first receiving slots and a set of second receiving slots formed in an alternate manner so the first and second contacts are arranged in the first and second receiving slots respectively. Each of the first contacts has an upper arm to abut against the movable cover and to prevent the movable cover lifting therefrom. Each of the second contacts has a conjunction portion and a resilient arm extending from a lateral side of the conjunction portion. The resilient arm has a projection portion protruding downwardly. The projection portion is forced to abut against a resilient electrical circuit board while the movable cover is pressed on the resilient arm of the respective second contact downwards.

In comparison with the prior art, the second contacts can be forced and abuts against an upper surface of the resilient electrical circuit board while the movable cover of the present invention is pressed. Thus, the resilient electrical circuit board electrically connects to the first contacts and the second contacts. Because the resilient property of upper parts of the second contacts guarantees the excellent touch between the second contacts and the resilient electrical circuit board, between the socket and the resilient electrical circuit board is good electrical connection.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED EMBODIMENTS

Figure 1:
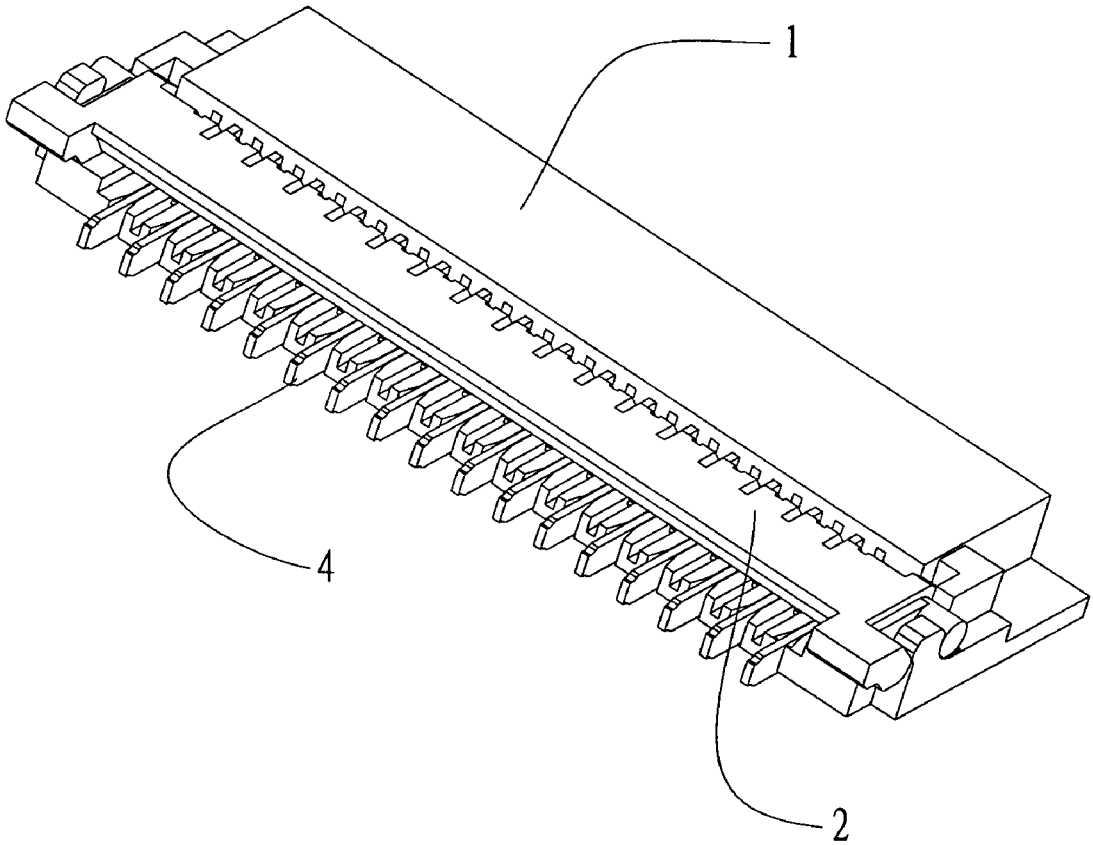
FIG. 1 is a perspective view of a socket according to the present invention.
Figure 2:
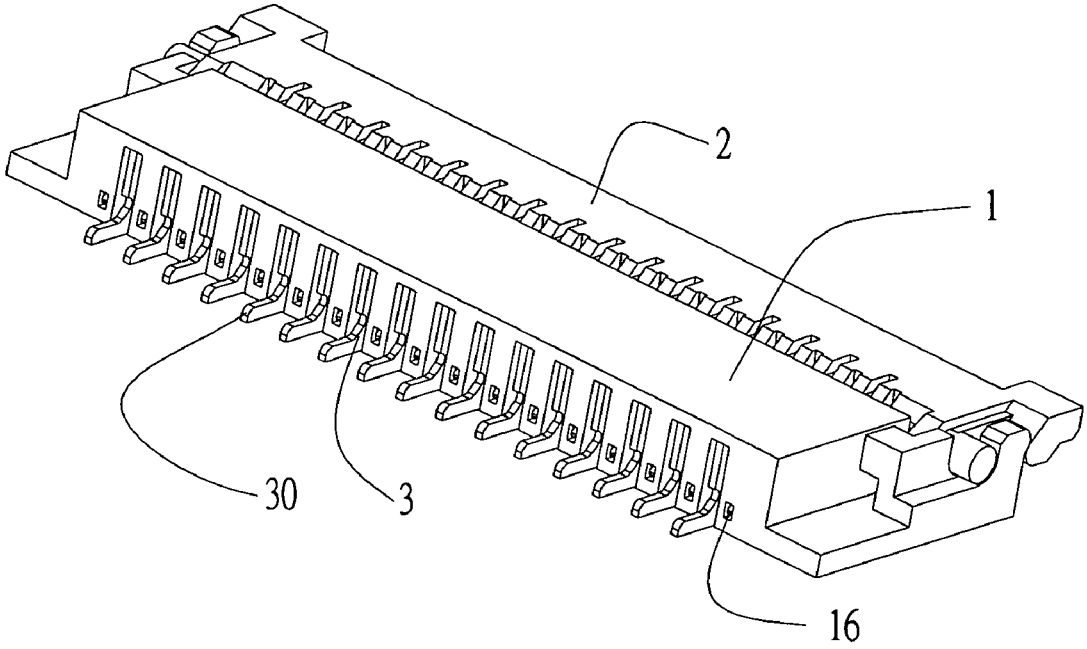
FIG. 2 is a perspective view of the socket from another visual angle according to the present invention.
Figure 3:
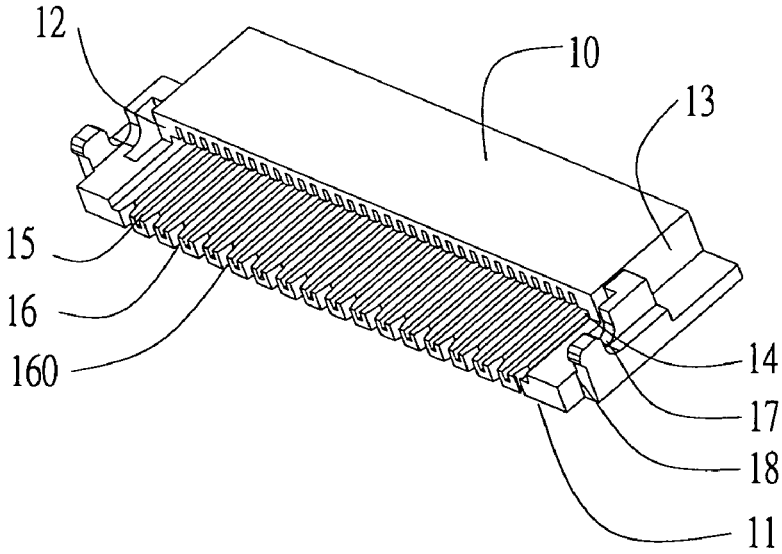
FIG. 3 is a perspective view of an insulating housing of the socket according to the present invention.
Figure 4:
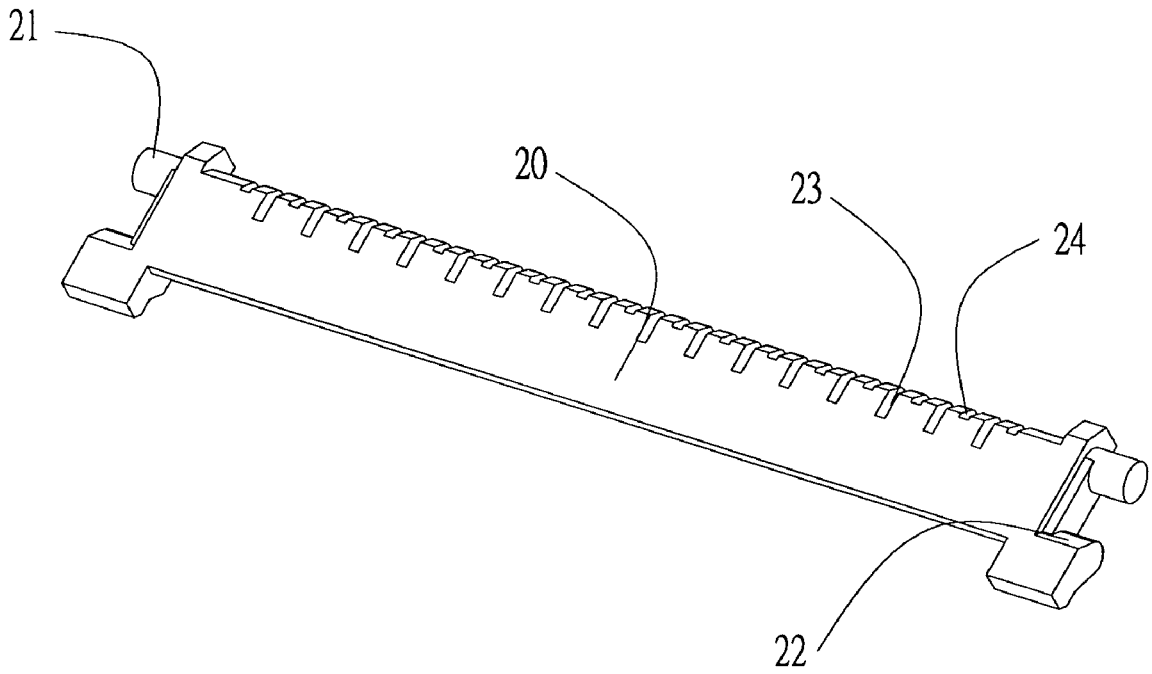
FIG. 4 is a perspective view of a movable cover of the socket according to the present invention.
Figure 5:
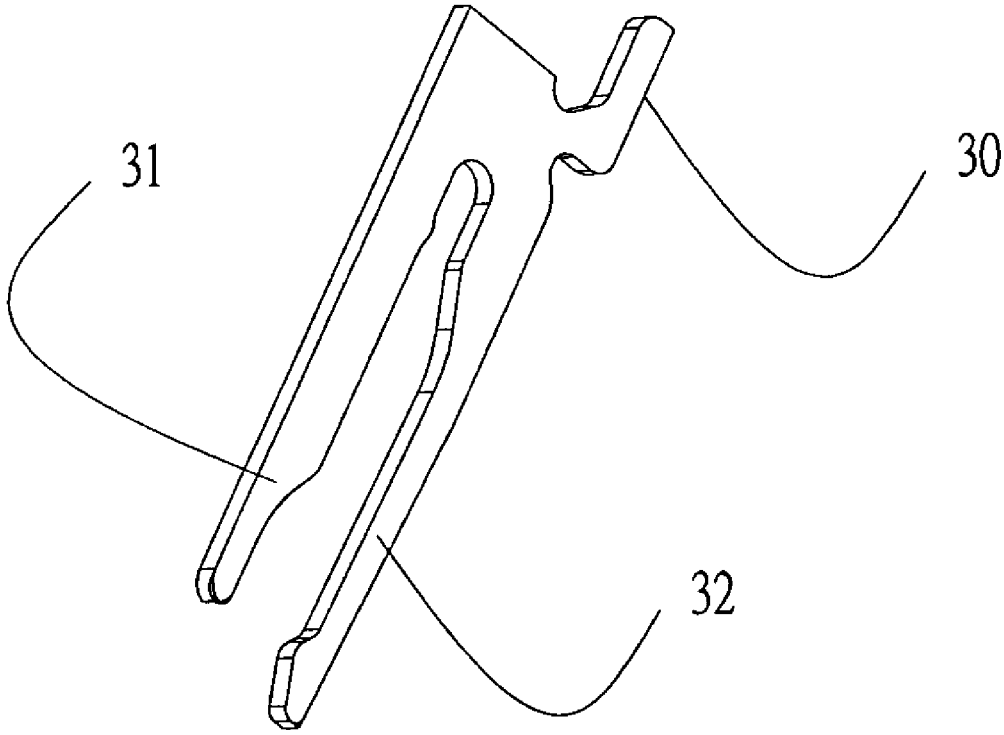
FIG. 5 is a perspective view of first contacts of the socket according to the present invention.
Figure 6:
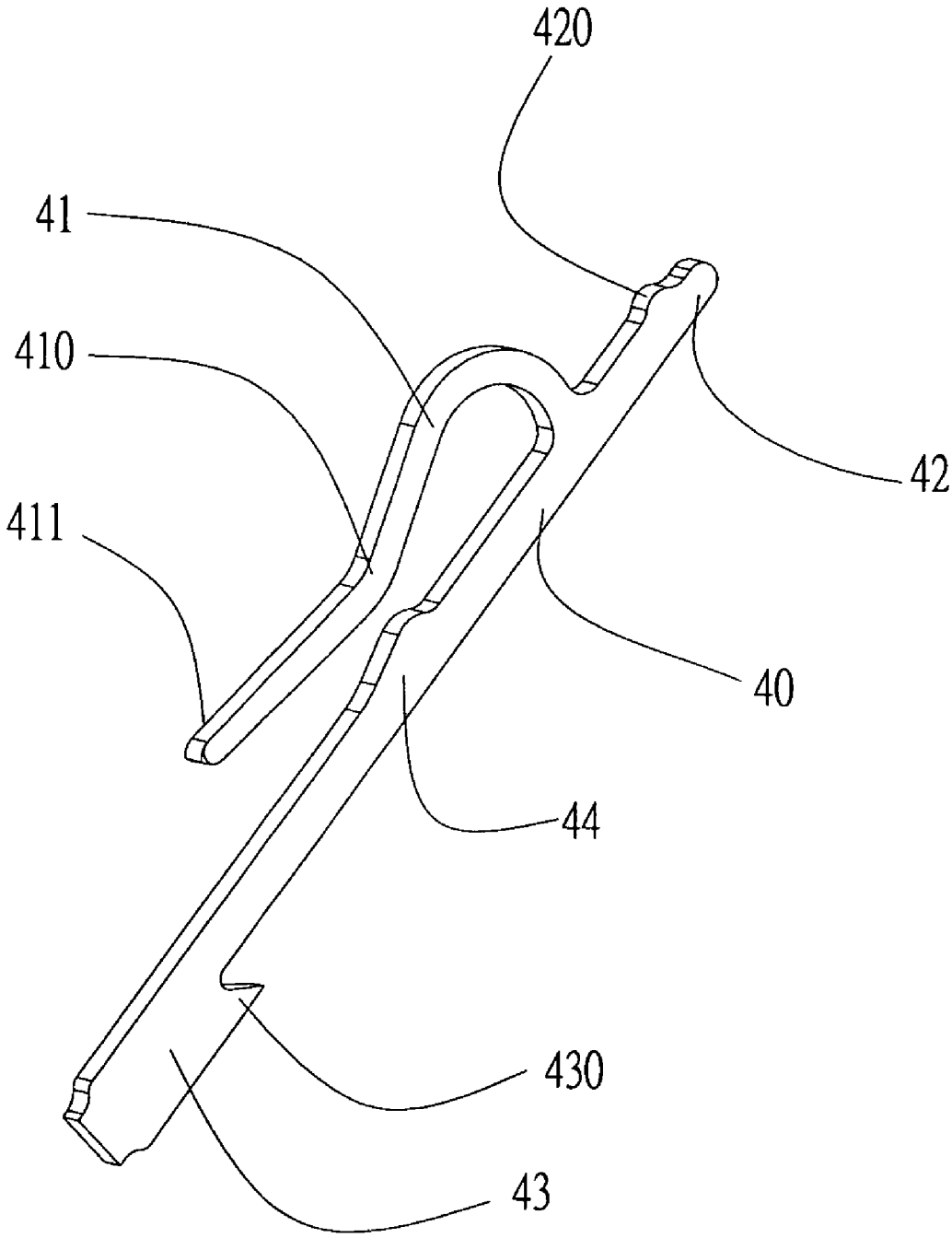
FIG. 6 is a perspective view of second contacts of the socket according to the present invention.
Figure 7:
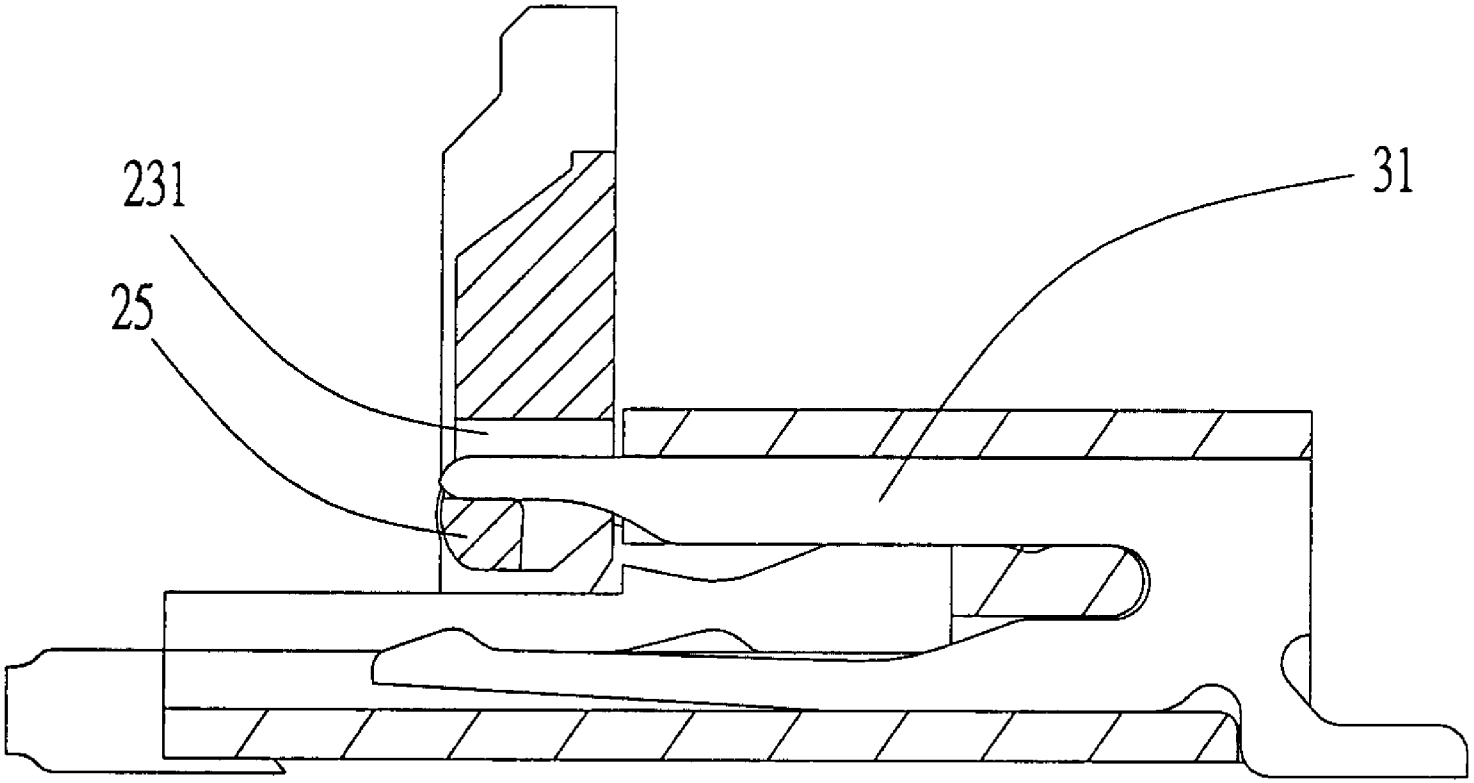
FIG. 7 is a cross-sectional profile illustrating the first contacts arranged in the insulating housing while the socket is open according to the present invention.
Figure 8:
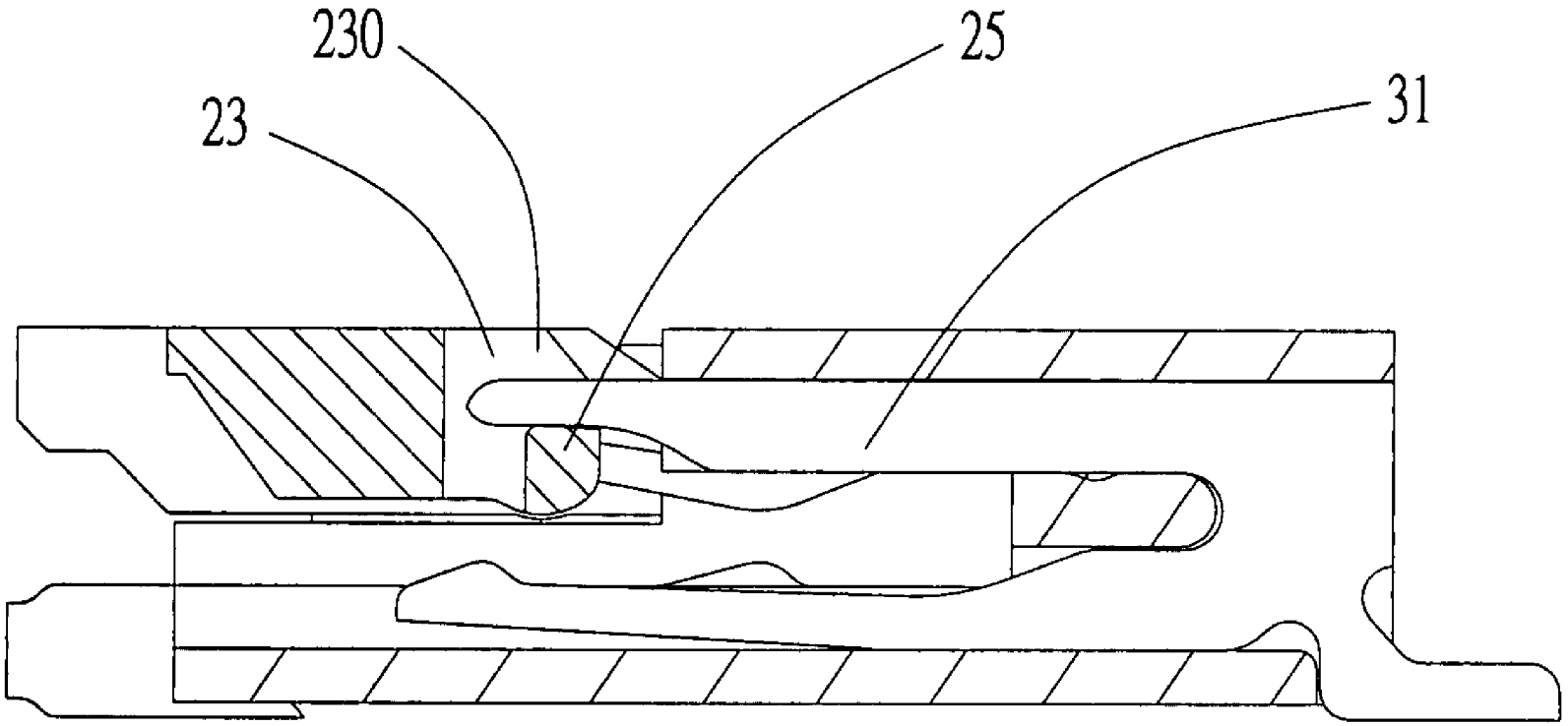
FIG. 8 is a cross-sectional profile illustrating the first contacts arranged in the insulating housing while the socket is close according to the present invention.
Figure 9:
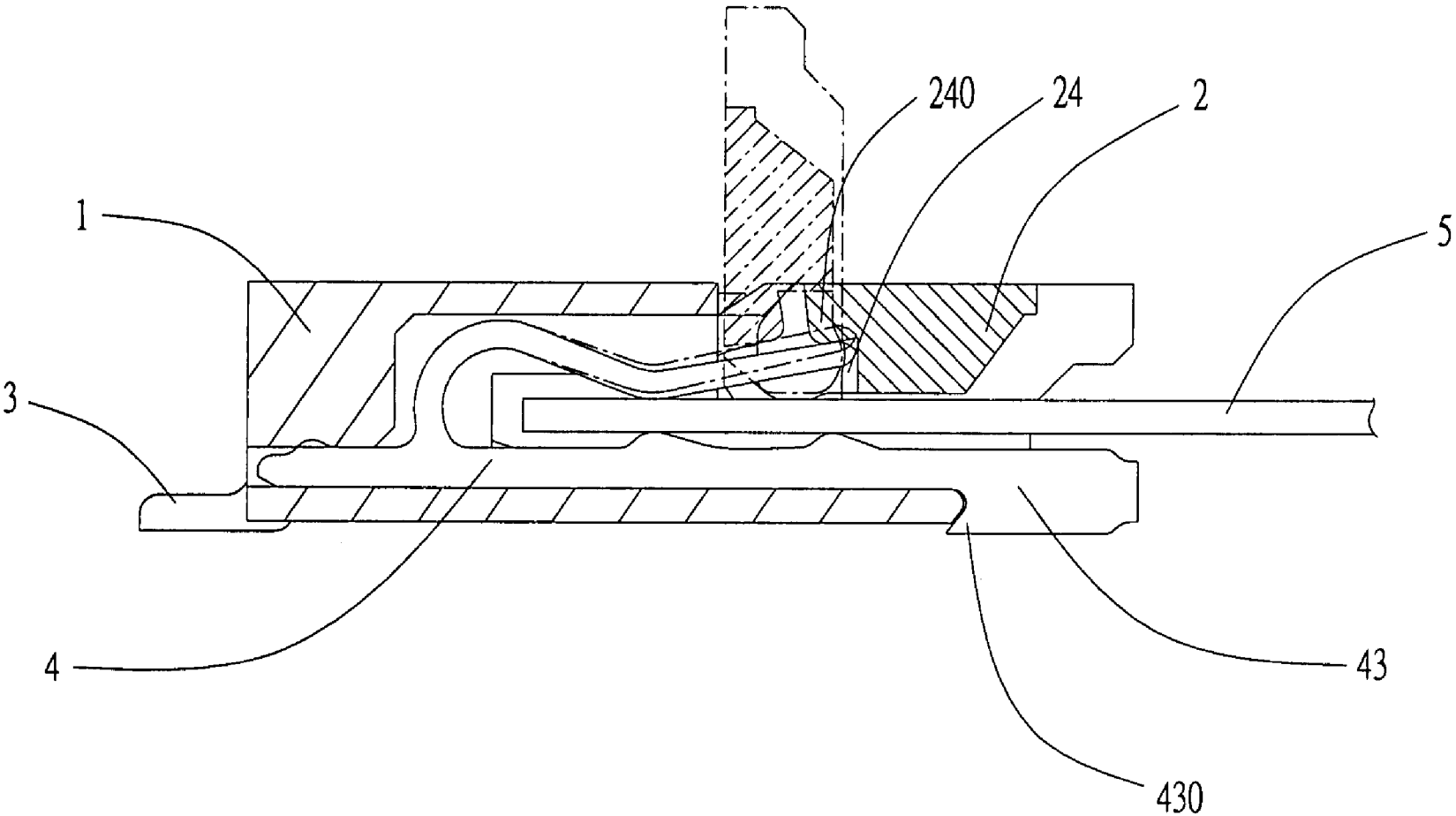
FIG. 9 is a cross-sectional profile illustrating the second contacts arranged in the insulating housing according to the present invention.

With respect to FIGS. 1 to 9, the socket according to the preset invention includes an insulating hosing 1, a movable cover 2, a set of first contacts 3 and a set of second contacts 4.

The insulating housing 1 has a top surface 10, a bottom surface 44, a mating surface 12 and a lateral sidewall 13. The insulating housing 1 has a ejection slot 14 formed on the mating surface 12 and defines an inner wall in the ejection slot 14. The inner wall of the reception slot 14 has a set of first receiving slots 15 and a set of second receiving slots 16. Each of the set of second receiving slots 16 is defined with a lower receiving slot 160 with a large-sized opening for assembling the second contacts 4. The lower receiving slot 160 is formed to penetrate insulating housing 1. The insulating housing 1 has a rotative slot 17 and a clamping portion 18 arranged on each lateral side thereof.

The movable cover 2 has a body 20 being plate-like substantially, and a rotative shaft 21 and a clamping arm 22 arranged on each lateral side of the body 20. The rotative shaft 21 mates with the rotative slot 17 for rotation therein. The clamping arm 22 mates with the clamping portion 18 so as to connect the movable cover 2 to the insulating housing 1. The movable cover 2 includes a plurality of openings 23, recesses 24 and protrusion portions 25 disposed among the openings 23 and recesses 24 for forming quantities of transverse slots 230 and lengthwise slots 231. The movable cover 2 further has a retaining block 240 disposed on an upper part of each recess 24.

The first contacts 3 are arranged in the first receiving slots 15. Each of the first contacts 3 has a solder portion 30 arranged on an end thereof, and an upper arm 31 and a lower arm 32 arranged on a rear part of the insulating housing 1 and opposing to the solder portion 30. The upper arm 31 abuts against the movable cover 2 and to prevent the movable cover 2 lifting therefrom. When the socket is open, the upper arm 31 locates inside the lengthwise slot 231 in FIG. 7. If the socket is close, the upper arm 31 locates in the transverse slot 230 in FIG. 8.

The second contacts 4 are arranged in the second receiving slots 16. Each of the second contacts 4 has a conjunction portion 40 and a resilient arm 41 extending from a lateral side of the conjunction portion 40 and parallel with the conjunction portion 40 substantially. The resilient arm 41 has a projection portion 410 protruding downwardly, and further extending from a touch portion 410 to a compression head 411. In addition, the conjunction portion 40 has a fasten arm 42 and a solder portion 43 extended from two lateral sidewalls thereof. The fasten arm 42 has an interference portion 420 in order to mate with the lower receiving slot 160. The solder portion 43 has an inverse hook 430 mating with a front portion of the insulating housing 1. The conjunction portion 40 has a touch portion 44 arranged thereon and connected to the resilient circuit electrical board. When the second contacts 4 are assembled into the second slots 16 from the front portion of the insulating housing 1, the conjunction portion 40 locates in the lower receiving slot 10, and the interference portion 420 of the fasten arm 42 interferes with the inner wall of the lower receiving slot 160. Then, the movable cover 2 is assembled to the insulating housing 1 for the rotative shaft 21 mating with the rotative slot 17. At the same time, the recess 24 accommodates with the compression head 411. If the movable cover 2 is rotated downwardly, the clamping arm 22 mates with the clamping portion 18 of the insulating housing 1. Thus, the movable cover 2 is close, the movable cover 2 abuts against and force to the compression head 411 and the projection portion 410 contacts the resilient electrical circuit board 5 tightly thereby in FIG. 9. Finally, the first contacts 3 are inserted in the insulating housing 1 from a rear part thereof. The upper arm 31 locates in the opening 23 and abuts against an upper surface of the respective protrusion portion 25 in order to prevent the movable cover 2 moving upwardly.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A socket for a resilient circuit board comprising:

an insulating housing having a plurality of first receiving slots formed therein interstitially with a plurality of second receiving slots;

a plurality of first contacts respectively received in each of the first receiving slots, each of the first contacts including an upper arm;

a plurality of second contacts respectively received in each of the second receiving slots, each of the second contacts having a conjunction portion and a resilient arm extending therefrom, the resilient arm including a downwardly protruding projection portion; and a movable cover pivotally received in the insulating housing, the movable cover having a plurality of openings spatially aligned with the first receiving slots and a plurality of recesses spatially aligned with the second receiving slots, the openings including a protrusion portion received under the upper arm of the first contacts to prevent the movable cover from being lifted therefrom, each of the recesses having respectively formed thereon a retaining block in direct contact with the resilient arm when the movable cover is in a closed position, wherein the projection portion of each the second contacts is forced to abut against the resilient electrical circuit board upon the retaining block on each of the recesses in the movable cover applying a downward force on the resilient arm of the second contacts when the movable cover is rotated into the closed position.

2. The socket for a resilient circuit board as claimed in claim 1, wherein the movable cover includes a transverse slot and a lengthwise slot communicating with each other around the protrusion portion in each of said openings, wherein an end of the upper arm locates in the lengthwise slot when the movable cover is in an open position and locates in the transverse slot when movable cover is in the closed position.

3. The socket for a resilient circuit board as claimed in claim 1, wherein the insulating housing includes a clamping portion, and the movable cover has a clamping arm relative to the clamping portion.

4. The socket for a resilient circuit board as claimed in claim 1, wherein the insulating housing has a rotative slot, and the movable cover has a rotative shaft corresponding to the rotative slot.

5. The socket for a resilient circuit board as claimed in claim 1, wherein the conjunction portion has a solder portion arranged on an end thereof and an inverse hook mating with a front portion of the insulating housing.

6. The socket for a resilient circuit board as claimed in claim 5, wherein the conjunction portion has a fasten portion arranged on an opposite end thereof and secured to the insulating housing.

* * * * *